United States Patent [19]

Boliard

[11] Patent Number: 4,587,673

[45] Date of Patent: May 13, 1986

[54] VOLLEYBALL PRACTICE GLOVES

[76] Inventor: Gregory A. Boliard, 6855 Lakeview, Apt. 4113, Westland, Mich. 48185

[21] Appl. No.: 728,040

[22] Filed: Apr. 29, 1985

[51] Int. Cl.[4] ..... A41D 19/00

[52] U.S. Cl. ..... 2/161 A; 2/159

[58] Field of Search ..... 2/161 A, 161 R, 160, 2/159, 158, DIG. 6; 273/411, DIG. 30, 412

[56] References Cited

U.S. PATENT DOCUMENTS 3,052,889 9/1962 Funey ..... 2/161 A
3,532,344 10/1970 Masstab ..... 2/160
4,239,228 12/1980 Norman et al. ..... 273/DIG. 30
4,351,067 9/1982 Bontels ..... 2/161 R
4,414,692 11/1983 Dzierson et al. ..... 2/160

*Primary Examiner*—Louis K. Rimrodt
*Assistant Examiner*—Joseph S. Machuga
*Attorney, Agent, or Firm*—Charles W. Chandler

[57] ABSTRACT

A pair of volleyball practice gloves in which one glove has a strip of Velcro fastener along the base of the palm and a second strip along the thumb, and the second glove has a cooperating strip of Velcro along the base of the palm and a second strip along the thumb so that the player's hands are releasably connected together during certain volleyball motions.

4 Claims, 2 Drawing Figures

VOLLEYBALL PRACTICE GLOVES

BACKGROUND OF THE INVENTION

This invention is related to volleyball practice gloves and more particularly to a pair of gloves having means for releasably connecting selected portions of one of the gloves to the other glove to assist the player in properly positioning her hands and arms for certain volleyball motions, such as the forearm pass.

Volleyball players frequently practice certain volleyball motions, such as the two-hand underhanded volley or forearm bump, in which the hands are joined in front of the body in any of a variety of ways depending upon the player's individual preference. The proper joining of the hands is essential for the correct positioning of the forearms. The arms must be extended at the elbows with the forearms pressed together. This position permits the ball to contact a relatively flat plane of the soft parts of the forearm.

SUMMARY OF THE INVENTION

The broad purpose of the present invention is to provide volleyball practice gloves in which the gloves have cooperating releasable connecting means which permit the user to join the hands together for certain volleyball motions and to separate the hands for other volleyball motions.

The preferred embodiment of the invention employs a strip of Velcro along the palm of each glove and a second strip along the thumb. When the player has a problem, for example, in bending her arms, she is instructed to straighten her arms with the gloves and to keep the thumbs parallel to one another. The Velcro along the gloves maintain the thumbs in such a position. The gloves assist the player to practice keeping the hands and forearms together.

Players practicing the "digging" motion can attain greater accuracy when using the inventive gloves. The reason is that the gloves encourage the player to keep the elbows fully extended and also prevent the hands from separating. It helps a "digger" to cushion a hard-spiked ball. The gloves are also very effective when a ball is out of reach and a full arm swing is needed to dig the ball.

Still further objects and advantages of the invention will become readily apparent to those skilled in the art to which the invention pertains upon reference to the following detailed description.

DESCRIPTION OF THE DRAWING

The description refers to the accompanying drawing in which like characters refer to like parts throughout the several views, and in which.

DESCRIPTION OF THE PREFERRED EMBODIMENT

Figure 1:
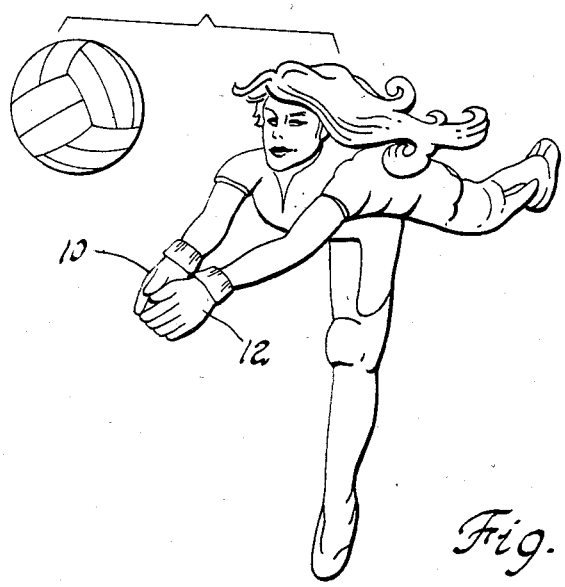
FIG. 1 illustrates a player employing the inventive gloves for "digging" a volleyball.
Figure 2:
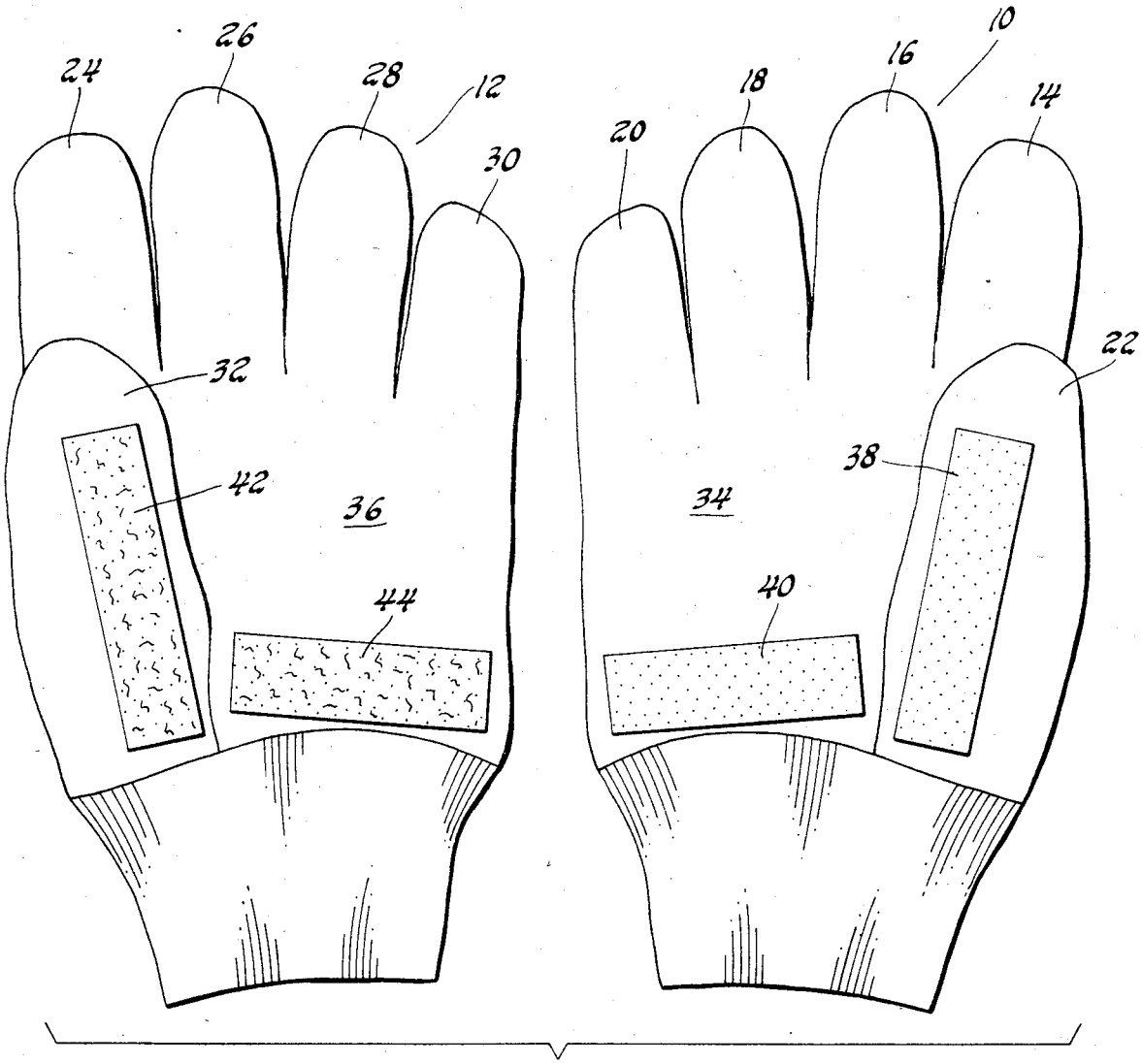
FIG. 2 is a view of the preferred gloves.

Referring to the drawing, a preferred pair of volleyball practice gloves are illustrated in FIGS. 1 and 2 and include right-hand glove 10 and left-hand glove 12. The gloves are formed of a fabric material with conventional fingers. Glove 10 has fingers 14, 16, 18 and 20 and a thumb 22 for receiving the user's fingers and thumbs.

Similarly, glove 12 has fingers 24, 26, 28 and 30 and thumb 32.

Glove 10 also has a palm section 34, while glove 12 has a palm section 36. It is to be noted that the thumb and fingers of glove 10 are arranged to fit the right hand of a user, while the thumb and fingers of glove 12 are arranged to fit the left hand of the player.

An elongated strip 38 of a pressure-sensitive fastener means is disposed along the thumb 22 of the right-hand glove, while an elongated strip 40 of a pressure-sensitive fastener means is attached to the base of the palm section 34. Preferably, pressure-sensitive fastener means 38 and 40 are formed of the commonly known Velcro hook tape.

An elongated strip 42 of a pressure-sensitive fastener, adapted to cooperate with strip 38 to fasten the two gloves together along the thumbs, is attached to thumb 32. An elongated fabric strip 44 of fastener adapted to releasably engage fastener strip 40 of the opposite glove, is mounted on glove 12 at the base of palm section 36. Preferably, fasteners 42 and 44 are formed of a Velcro pile fabric tape, adapted to releasably engage strips 38 and 40.

In use, the player inserts her hands into the two gloves and then practices in the conventional manner. For those volleyball motions such as the forearm pass, or dig, she places the two gloves together so that fastener 40 engages fastener 44 and fastener 38 engages fastener 42, while her hands are closely placed together with the palms aligned. For those volleyball motions in which her hands are separated, she separates the two gloves by merely moving one hand away from the other.

Having described my invention I claim:

1. Volleyball practice gloves, comprising:

a pair of fabric gloves, including a right-hand glove and a left-hand glove, each having a palm section and a thumb section;

the palm section on the right-hand glove having pressure-sensitive connecting means, and the thumb section on the right-hand glove having pressure-sensitive connecting means;

the palm section on the left hand having cooperating pressure-sensitive connecting means for releasably connecting the palm section of the left-hand glove to the palm section of the right-hand glove;

the thumb section on the left-hand glove having pressure-sensitive connecting means cooperating with the pressure-sensitive connecting means on the thumb section of the right-hand glove for releasably connecting the thumb section of the right-hand glove to the thumb section of the left-hand glove;

whereby the right-hand glove and the left-hand glove may be worn on the hands of a volleyball user such that he can join the right-hand glove to the left-hand glove in a palm-to-palm and a thumb-to-thumb releasable connection for striking a volleyball with both hands in a striking motion.

2. Volleyball practice gloves as defined in claim 1, in which the pressure-sensitive connecting means comprises:

a Velcro hooked tape on one of said pair of gloves; and a Velcro pile tape on the second of said pair of gloves.

3. Volleyball practice gloves, comprising:

a pair of fabric gloves, including a right-hand glove and a left-hand glove, each having a palm section;

the palm section of the right hand glove having pressure-sensitive connecting means; and the palm section of the left hand glove having cooperating pressure-sensitive connecting means for releasably connecting the palm section of the right-hand glove to the palm section of the left-hand glove at such times as the gloves are being worn by a volleyball player, such that the player may strike a ball with both hands in a palm-to-palm relationship.

4. Volleyball practice gloves, comprising:

a pair of fabric gloves, including a right-hand glove and a left-hand glove, each having a thumb section;

the thumb section of the right hand glove having pressure-sensitive connecting means;

the thumb section of the left hand glove having cooperating pressure-sensitive connecting means for releasably connecting the thumb of the right-hand glove to the thumb section of the left-hand glove at such times as the gloves are being worn by a volleyball player, such that the player may strike a ball with both hands in a thumb-to-thumb relationship.

* * * * *